United States Patent [19]

Powers

[11] 4,384,716

[45] May 24, 1983

[54] FLIPPER CONTROL CIRCUIT

[75] Inventor: Emmett J. Powers, Elk Grove Village, Ill.

[73] Assignee: Universal Research Laboratories, Incorporated, Elk Grove Village, Ill.

[21] Appl. No.: 231,874

[22] Filed: Feb. 5, 1981

[51] Int. Cl.[3] ..... A63F 7/00

[52] U.S. Cl. ..... 273/121 A; 273/129 V; 361/152

[58] Field of Search ..... 273/129 U, 129 W, 118 A, 273/119 A, 120 A, 121 A; 361/154

[56] References Cited

U.S. PATENT DOCUMENTS

| | | | |
|---|---|---|---|
| 3,594,615 | 7/1971 | Cortelli | 361/154 |
| 4,093,232 | 6/1978 | Nutting et al. | 273/121 A |
| 4,198,051 | 4/1980 | Bracha et al. | 273/121 A |
| 4,234,903 | 11/1980 | Harper | 361/154 |
| 4,293,888 | 10/1981 | McCarty | 361/154 |

*Primary Examiner*—Vance Y. Hum
*Assistant Examiner*—Leo P. Picard
*Attorney, Agent, or Firm*—George H. Gerstman

[57] ABSTRACT

An electronic control circuit is provided for controlling the operation of pinball machine flippers. Each flipper is operated in response to the energization of a single solenoid coil in which the same winding is energized to place the flipper in an actuated position and to hold the flipper in the actuated position. When a flipper switch is activated, a full wave rectified voltage is applied to the solenoid coil to place the flipper in an actuated position. When the flipper has been sensed to be in the actuated position, only a partial phase controlled voltage is applied to the solenoid coil to hold the flipper in the actuated position until the flipper switch is deactivated.

7 Claims, 3 Drawing Figures

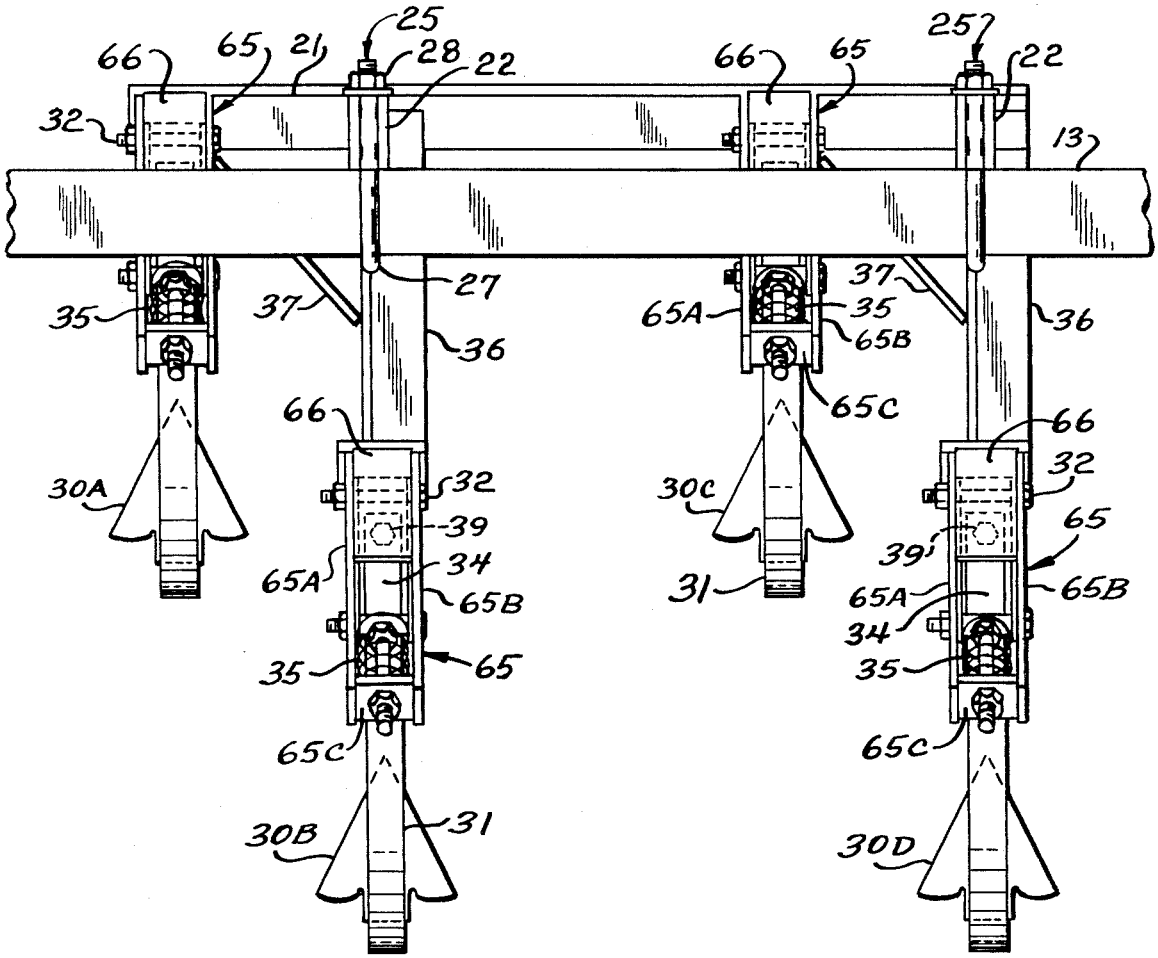
FIG. 3
FIG. 4
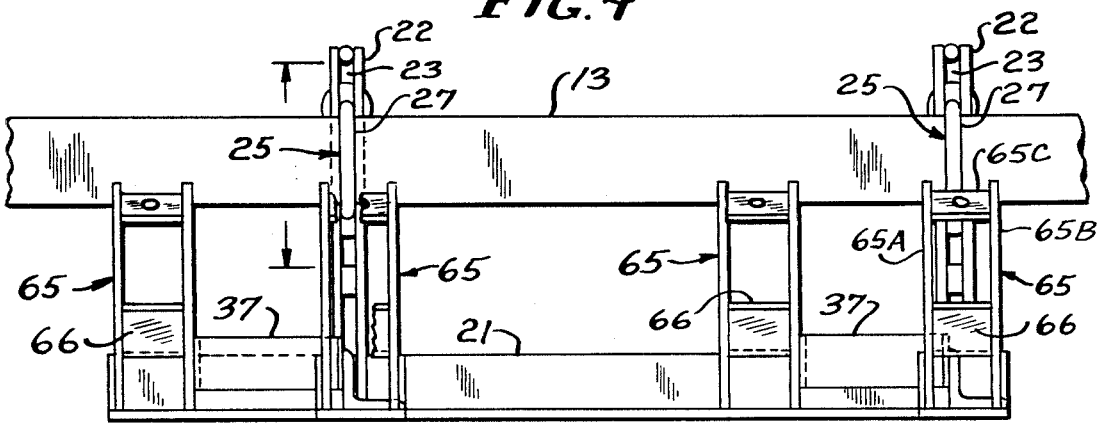

FLIPPER CONTROL CIRCUIT

BACKGROUND OF THE INVENTION

The present invention concerns a novel electronic control circuit for controlling the operation of pinball machine flippers.

Conventional pinball flipper circuitry utilizes a dual-winding solenoid coil. One winding serves to provide a strong pull on the solenoid core for the power stroke and a second "holding" winding serves to hold the flipper in the actuated position. This arrangement is necessary since a single coil winding has not been considered capable of both high power and continuous operation. When the flipper is at rest, a normally closed "end-of-travel" switch bypasses the holding winding, leaving only the power winding in the circuit. When the flipper is actuated, the power winding is active throughout the mechanical stroke until, at the end of its travel, the flipper mechanism opens the "end-of-travel" switch and places the low power holding winding in the circuit. This arrangement requires that the flipper switch and "end-of-travel" switch break a high current circuit with resulting arcing and contact wear. The high current levels required also necessitate the use of a relay to enable or disable the flipper circuits under control of the game logic.

It is an object of the present invention to providea flipper control circuit in which high current loads on the switches are eliminated.

Another object of the present invention is to provide a flipper control circuit which obviates the need for the dual-winding solenoid coil and relay.

Another object of the present invention is to provide a flipper control circuit which is simple in operation and efficient to manufacture.

Other objects and advantages of the present invention will become apparent as the description proceeds.

SUMMARY OF THE INVENTION

In accordance with the present invention, an electronic control circuit is provided for controlling the operation of pinball machine flippers which are operated in response to the energization of a solenoid coil. A single solenoid coil is provided in which the same winding is energized to place the flipper in an actuated position and to hold the flipper in the actuated position.

Means are provided for applying a first voltage to the solenoid coil when the flipper switch is activated, to place the flipper in an actuated position, and for applying only a part of the first voltage to the solenoid coil when the flipper is in the actuated position, to hold the flipper in the actuated position until the flipper switch is deactivated.

In the illustrative embodiment, means are provided for sensing when the flipper is in the actuated position and means are provided for controlling the applying means in response to the sensing means.

In the illustrative embodiment, the applying means comprises means for providing a timing signal referenced to the start of each voltage cycle, a delay circuit for effecting phase control, a gate for receiving a flipper-activated signal and a signal from the sensing means, a latch controlled by the gate, and a solenoid coil driver controlled by the latch.

A more detailed explanation is provided in the following description and claims, and is illustrated in the accompanying drawings.

DETAILED DESCRIPTION OF THE ILLUSTRATIVE EMBODIMENT

Figure 1:
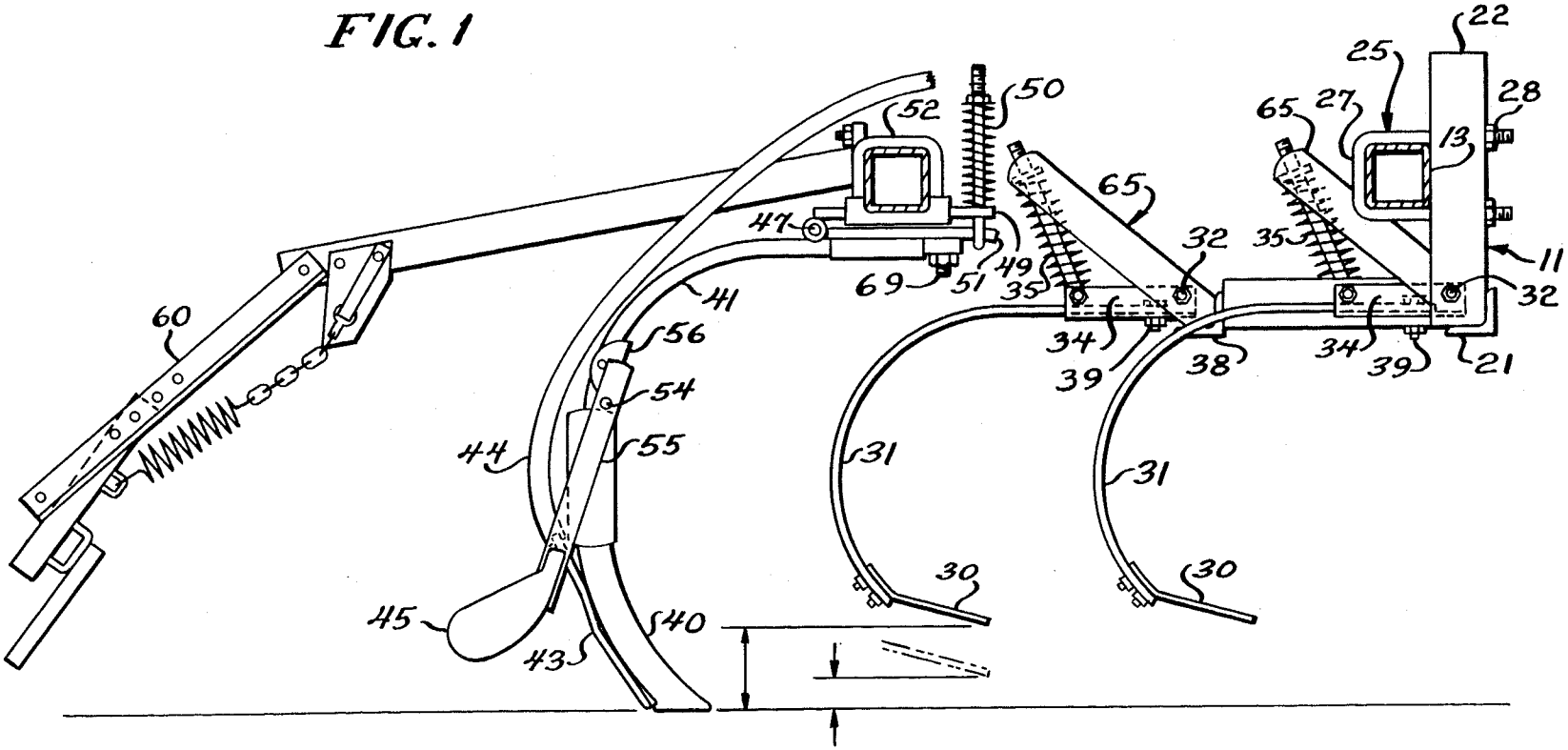
FIGS. 1 and 2, when connected together, comprise a schematic circuit diagram of a flipper control circuit constructed in accordance with the principles of the present invention.

In the illustrative embodiment, the main supply voltage comprises a full wave rectified voltage having a peak of 48 volts and a low of 0 volts (see FIG. 3A). This supply voltage is applied at points 10 (FIG. 1A) and 12 (FIG. 2C).

Referring to FIG. 1A, the full wave rectified supply voltage is applied at point 10 to a resistor 14 and capacitor 16 which is grounded. A line 18 coupled to the junction of resistor 14 and capacitor 16 is coupled to the positive terminal of a comparator 20 through resistor 22, and is coupled to the negative terminal of comparator 20 through a zener diode 24 and a resistor 26. Although no limitation is intended, as an example comparator 20 could comprise an LM311 integrated circuit.

The output of comparator 20 is coupled to an inverter 28, to form a zero-crossing detector circuit for producing a negative going pulse (FIG. 3B) each time the 48 volts suppy (FIG. 3A) goes to zero at the start of each half cycle. This negative going pulse (FIG. 3B) triggers the delay circuit of FIG. 1B.

The delay circuit comprises a one-shot multivibrator 30, acting as a timer, the trigger input of which is coupled to the output of inverter 28, and the output of which is coupled via line 32 to an inverter 34. The open collector output of inverter 34 turns on when the timer 30 is triggered, remaining on until the delay time (FIG. 3C) has elapsed, at which point it turns off. This provides a "flipctl" signal (FIG. 3C) which is used by the gate and latch circuits of the individual flipper assemblies of the pinball machine. The zero crossing detector (FIG. 1A) and delay (FIG. 1B) stages provide a control signal which can be common to any number of flipper assemblies and can therefore be located on the pinball logic board. The other elements to be described, are duplicated on each flipper assembly.

The gate circuit is shown in FIG. 2A. Referring to FIG. 2A, a comparator 36 has coupled to its negative input a varying voltage reference depending upon the "flipctl" signal on line 38 from the delay circuit of FIG. 1B. The signal on line 38 is coupled to the inverting or negative input terminal of comparator 36 via resistor 40 and through a voltage divider comprising resistors 41 and 42.

A flipper switch 44, which is conventionally controlled by the pinball machine player, is coupled to the positive or non-inverting input of comparator 36 through diode 46. A flipper sensor switch 48 is coupled to the non-inverting or positive input of comparator 36 through diode 49. Sensor switch 48 could comprise an end-of travel switch in mechanical form or solid state form, or could comprise a timing switch which is operated a predetermined time after the flipper switch 44 is activated.

The gate circuit of FIG. 2A controls the operation of the flipper coil driver (FIG. 2C) according to the states of the flipper switch 44, the sensor switch 48 and the reference voltage at the inverting or negative input of comparator 36. In the illustrative embodiment, the reference voltage at the negative input of comparator 36 varies between 3 volts and 6 volts according to the state of the "flipctl" signal on line 38, which is applied through resistor 40 to the voltage divider comprising resistors 41 and 42. This varying reference voltage is applied to the negative input of the comparator as illustrated.

The voltage at the positive or non-inverting input of the comparator 36 is determined by the flipper switch 44 and sensor switch 48 as follows:

In the inactive state of the flipper, flipper switch 44 is open and the voltage at input 50 is pulled up to approximately 8 volts via resistor 52 through diode 46. Diode 49 is reverse biased and is effectively out of the circuit as is the sensor switch 48, which is closed at this time. Since the voltage to line 50 is a constant 8 volts and the voltage to line 54 varies between 3 volts and 6 volts, the output of comparator 36 stays high any time that flipper switch 44 is open.

When flipper switch 44 is closed to activate the pinball machine flipper, diode 46 is reverse biased and since switch 48 is also again closed at this time, line 50 is grounded. The voltage at line 50 is always less than the voltage at line 54 at that time and the output of comparator 36 stays low until switch 48 is opened. When switch 48 is open, the voltage at line 50 becomes the voltage at point 56 from the voltage divider comprising resistors 58 and 59, which is approximately 4.5 volts. This is in the range of the varying limits of the voltage at line 54, which causes the output of comparator 36 to go low each time the voltage at line 54 goes high (see FIG. 3D).

It should be noted that the flipper can be disabled or enabled by a logic level if the flipper switch 44 is returned to that logic level rather than to ground.

Whenever the output of comparator 36 goes low, the output of the latch circuit of FIG. 2B, including comparator 60, goes low, turning on the solenoid driver circuit of FIG. 2C. In the latch circuit of FIG. 2B, the positive terminal of comparator 60 is coupled to the output of comparator 36 and the negative terminal of comparator 60 is coupled to line 38 via diode 62 and capacitor 64, with suitable reference voltages being provided by resistor 66 and resistors 67 and 68 coupled to the negative input terminal of comparator 60.

The output of comparator 60 does not return to its high state until it is reset by the negative going edge of the "flipctl" signal on line 38. The signal on line 38 is differentiated by capacitor 64 before it is applied to the negative terminal of comparator 60, in order to effect the state change. Thus once the latch is set by the gate output, turning on the solenoid driver, the driver circuit cannot turn off until the zero crossing point of the supply voltage. This prevents the development of high inductive kickback voltage transients and consequent secondary-break-down failure of the driver transistor, which could occur if the driver were turned off midway in the power supply voltage cycle.

The driver circuit of FIG. 2C comprises a PNP transistor 70, the base of which is coupled via resistor 72 to the output of the latch. The collector of transistor 70 is coupled through resistor 74 to the base of a cascaded NPN transistor pair 76, the collector emitter circuit of which is connected in series with the flipper solenoid coil 80.

Solenoid coil 80 comprises a single solenoid coil in which the same winding is energized to place the flipper in an actuated position and to hold the flipper in the actuated position. Coil 80 is shunted by a diode 82, as illustrated in FIG. 2C.

Since the driver is on any time that the output of the gate is low, power to the solenoid coil 80 is controlled in the following manner:

Whenever the flipper switch 44 is open, the output of the comparator 36 is always high and the driver is always off, and no voltage is applied to coil 80. When the flipper switch 44 and the sensor switch 48 are both closed (during the flipper stroke), the output of the comparator 36 is always low, the driver is always on and full power supply voltage cycles (FIG. 3A) are applied to coil 80. When the sensor switch 48 opens, for example, at the completion of the flipper stroke, the output of comparator 36 is low only during the last part of each supply voltage half cycle, with the actual "on" time being a function of the delay time t. Thus a partial half cycle voltage is applied to the coil 80. This reduced voltage is sufficient to hold the solenoid in the actuated position without overheating the coil winding.

It can be seen that the circuit described herein preserves the control characteristics of the conventional flipper circuitry by retaining an "end-of-travel" switch, if desired, which is actuated by mechanical means to provide a true "end-of-travel" indication. Both the flipper switch 44 and the sensor switch 48 could be implemented as solid state devices, if desired, since neither has to switch a high current or voltage, If desired, the sensor switch could sense another parameter of the flipper. For example, it could sense a portion of the travel of the flipper instead of sensing the end-of-travel, or it could sense a predetermined elapsed time subsequent to activation of the flipper switch 44.

Although an illustrative embodiment of the invention has been shown and described, it is to be understood that various modifications and substitutions may be made by those skilled in the art without departing from the novel spirit and scope of the present invention.

What is claimed is:

1. In a pinball machine happing a flipper and including a flipper switch for activating the flipper and means for holding the flipper in an actuated position until the flipper switch is deactivated, the improvement comprising:

a solenoid coil for controlling the movement of the flipper in response to the voltage applied to the solenoid coil; and means for applying a rectified voltage to the solenoid coil when the flipper switch is activated, to place the flipper in an actuated position, and means for applying only a partial phase controlled voltage to the solenoid coil when the flipper is in the actuated position, to hold the flipper in the actuated position until the flipper switch is deactivated.

2. A device as described in claim 1, including means for sensing when the flipper is in the actuated position and means for controlling said applying means in response to said sensing means.

3. A device as described in claim 2, said sensing means comprising an end-of-travel switch that changes state when the flipper has pivoted to its full desired limit.

4. A device as described in claim 2, said applying means comprising means for providing a timing signal referenced to the start of each supply-voltage cycle, a delay circuit for effecting phase control, a gate for receiving a flipper-activated signal and a signal from the sensing means, a latch controlled by the gate, and a selenoid coil driver controlled by the latch.

5. A device as described in claim 4, said timing signal means comprising a zero crossing detector including a comparator for providing a pulse each time the supply voltage goes to a predetermined level.

6. A device as described in claim 4, said gate comprising a comparator having an inverting input and a noninverting input; means for applying a reference voltage to said inverting input and means for applying to the non-inverting input the flipper signal and the sensing means signal.

7. In a pinball machine having a flipper and including a flipper switch for activating the flipper and means for holding the flipper in an actuated position until the flipper switch is deactivated, the improvement comprising:

a solenoid coil for controlling the movement of the flipper in response to the voltage applied to the solenoid coil;

means for applying a full wave rectified voltage to the solenoid coil when the filler switch is activated, to place the flipper in an actuated position, and means for applying only a partial phase controlled voltage to the solenoid coil when the flipper is in the actuated position, to hold the flipper in the actuated position until the flipper switch is deactivated;

means for sensing when the flipper is in the actuated position and means for controlling said applying means in response to said sensing means;

said sensing means comprising an end-of-travel switch that changes state when the flipper has pivoted to its full desired limit;

said applying means comprising means for providing a timing signal referenced to the start of each supply-voltage cycle, a delay circuit for effecting phase control, a gate for receiving a flipper-activated signal and a signal from the sensing means, a latch controlled by the gate, and a solenoid coil driver controlled by the latch;

said timing signal means comprising a zero crossing detector including a comparator for providing a pulse each time the supply voltage goes to a predetermined level;

said gate comprising a comparator having an inverting input and a non-inverting input; means for applying a reference voltage to said inverting input and means for applying to the non-inverting input the flipper signal and the sensing means signal.

* * * * *

UNITED STATES PATENT AND TRADEMARK OFFICE

CERTIFICATE OF CORRECTION

PATENT NO. : 4,384,716

DATED : May 24, 1983

INVENTOR(S) : Emmett J. Powers

It is certified that error appears in the above-identified patent and that said Letters Patent is hereby corrected as shown below:

The title page showing the illustrative figure should be deleted to appear as per attached title page.

Figure 2:
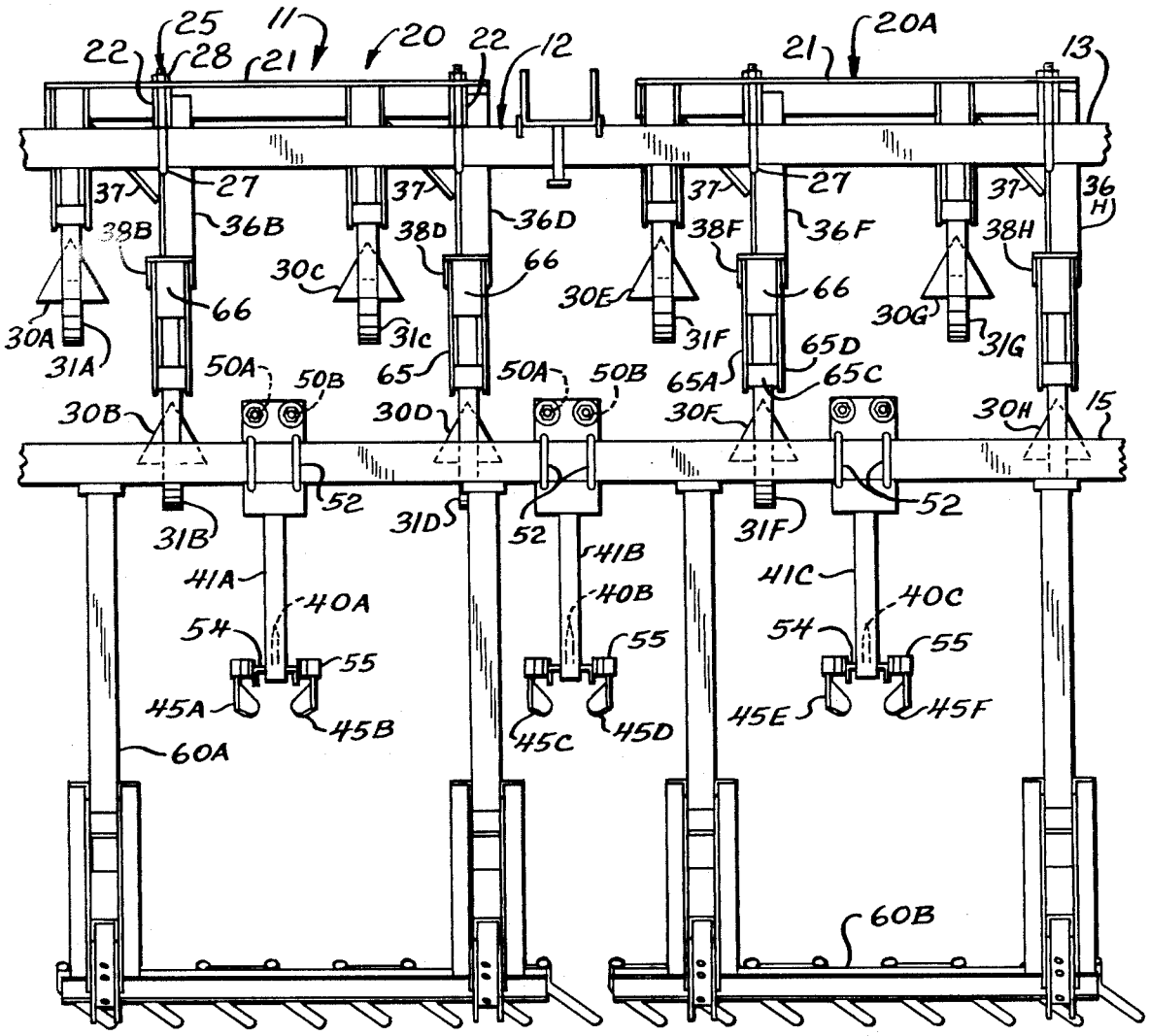
Figure 5:
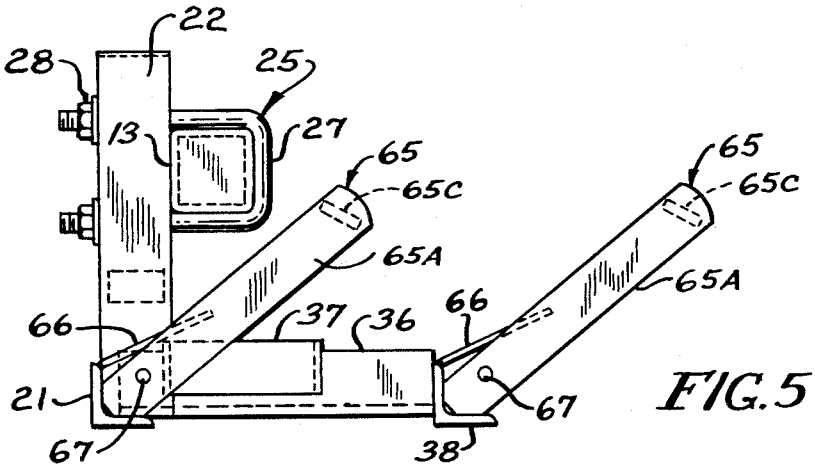
Figure 1:
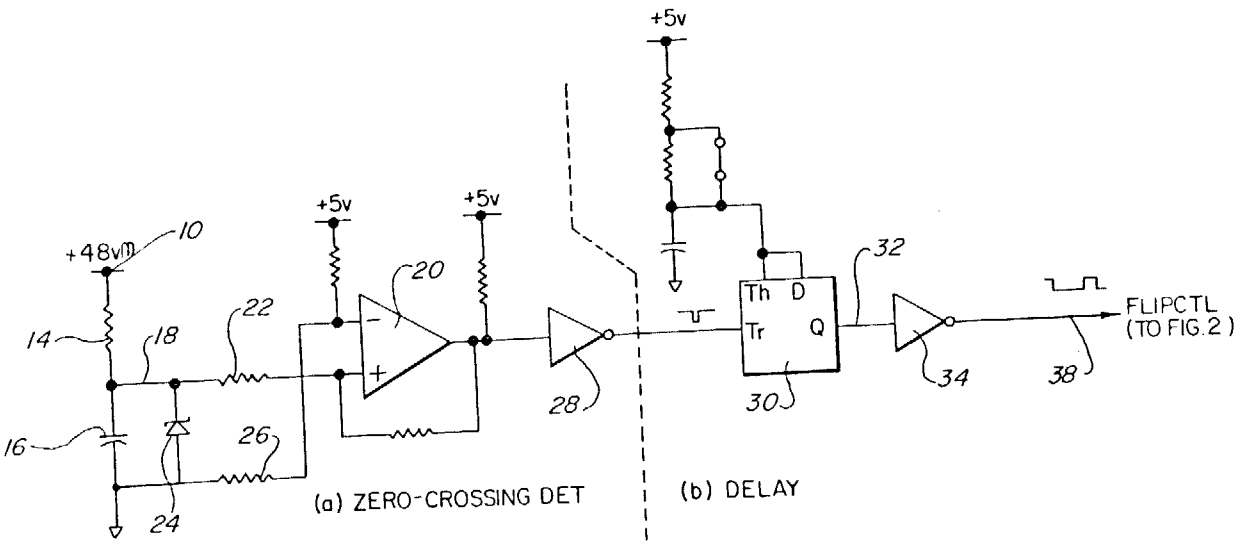
Figure 2:
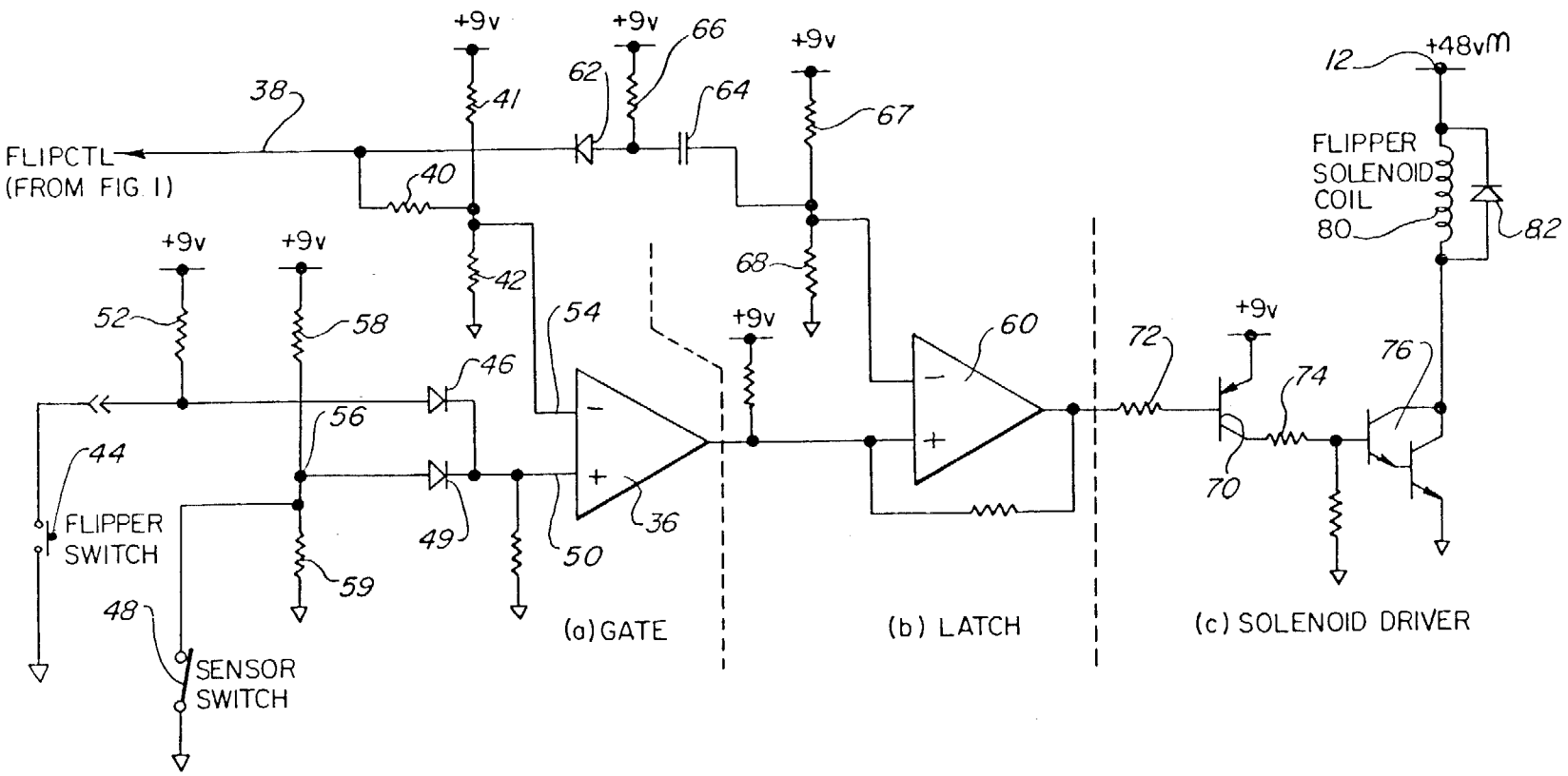
Figure 3:
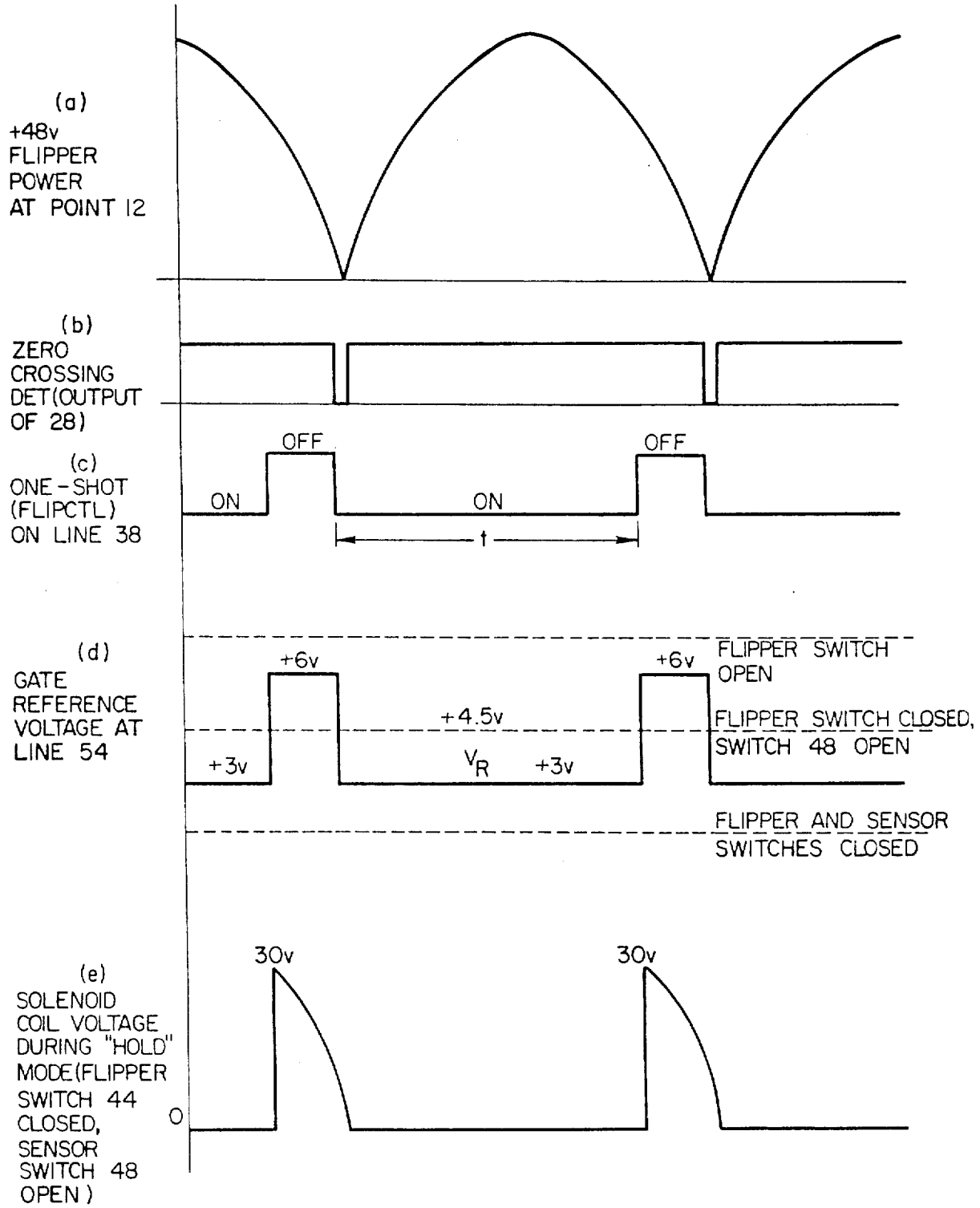
FIG. 3 is a time diagram showing the waveforms of the circuit of FIGS. 1 and 2.

The sheets of drawing consisting of Figures 1, 2, 3, 4 and 5 should be cancelled and the attached sheets showing Figures 1, 2 and 3 substituted therefor.

Signed and Sealed this

*Sixteenth* Day of *August 1983*

[SEAL]

*Attest:*

GERALD J. MOSSINGHOFF

*Attesting Officer*

*Commissioner of Patents and Trademarks*

United States Patent [19]

Powers

[11] 4,384,716

[45] May 24, 1983

[54] FLIPPER CONTROL CIRCUIT

[75] Inventor: Emmett J. Powers, Elk Grove Village, Ill.

[73] Assignee: Universal Research Laboratories, Incorporated, Elk Grove Village, Ill.

[21] Appl. No.: 231,874

[22] Filed: Feb. 5, 1981

[51] Int. Cl.[3] ..... A63F 7/00

[52] U.S. Cl. ..... 273/121 A; 273/129 V; 361/152

[58] Field of Search ..... 273/129 U, 129 W, 118 A, 273/119 A, 120 A, 121 A; 361/154

[56] References Cited

U.S. PATENT DOCUMENTS

| | | | |
|---|---|---|---|
| 3,594,615 | 7/1971 | Cortelli | 361/154 |
| 4,093,232 | 6/1978 | Nutting et al. | 273/121 A |
| 4,198,051 | 4/1980 | Bracha et al. | 273/121 A |
| 4,234,903 | 11/1980 | Harper | 361/154 |
| 4,293,888 | 10/1981 | McCarty | 361/154 |

*Primary Examiner*—Vance Y. Hum
*Assistant Examiner*—Leo P. Picard
*Attorney, Agent, or Firm*—George H. Gerstman

[57] ABSTRACT

An electronic control circuit is provided for controlling the operation of pinball machine flippers. Each flipper is operated in response to the energization of a single solenoid coil in which the same winding is energized to place the flipper in an actuated position and to hold the flipper in the actuated position. When a flipper switch is activated, a full wave rectified voltage is applied to the solenoid coil to place the flipper in an actuated position. When the flipper has been sensed to be in the actuated position, only a partial phase controlled voltage is applied to the solenoid coil to hold the flipper in the actuated position until the flipper switch is deactivated.

7 Claims, 3 Drawing Figures

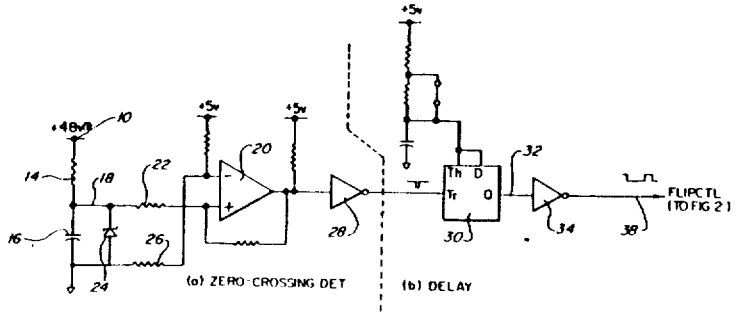

FLIPPER CONTROL CIRCUIT, PINBALL LOGIC BOARD SECTION

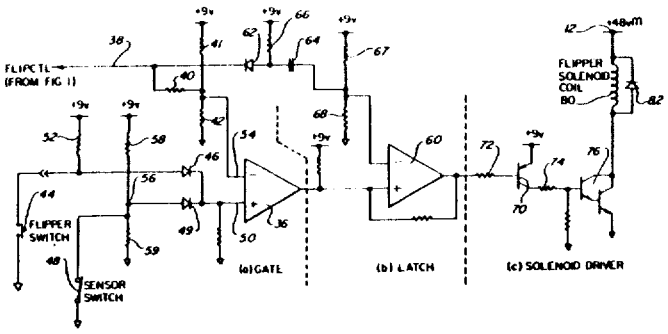

Patent No. 4,384,716

May 24, 1983

FLIPPER CONTROL CIRCUIT, PINBALL LOGIC BOARD SECTION